United States Patent [19]

Nagasawa et al.

[11] Patent Number: 4,562,650

[45] Date of Patent: Jan. 7, 1986

[54] BOARD DRYING APPARATUS

[75] Inventors: Kiyoshi Nagasawa, Chita; Eiichi Itoh; Sadao Kato, both of Tokai, all of Japan

[73] Assignee: Hashimoto Denki Co., Ltd., Aichi, Japan

[21] Appl. No.: 587,703

[22] Filed: Mar. 8, 1984

[30] Foreign Application Priority Data

Mar. 23, 1983 [JP] Japan ..... 58-49292

[51] Int. Cl.[4] ..... F26B 15/20

[52] U.S. Cl. ..... 34/149; 34/236; 271/192

[58] Field of Search ..... 34/107, 149, 219, 227, 34/236; 198/607, 611, 782, 424; 271/192, 189

[56] References Cited

U.S. PATENT DOCUMENTS

| | | | |
|---|---|---|---|
| 1,564,491 | 12/1925 | Rees et al. | 34/219 |
| 3,074,180 | 1/1963 | Ahlstedt | 34/219 |
| 3,520,396 | 7/1970 | Lingg | 198/782 |
| 3,848,725 | 11/1974 | Toby | 198/782 |

FOREIGN PATENT DOCUMENTS

| | | | |
|---|---|---|---|
| 488062 | 12/1953 | Italy | 34/149 |

*Primary Examiner*—Larry I. Schwartz
*Assistant Examiner*—David W. Westphal
*Attorney, Agent, or Firm*—Wenderoth, Lind & Ponack

[57] ABSTRACT

A board drying apparatus includes a pair of fork conveyors provided in a housing and disposed vertically with spacing therebetween. Each fork conveyor has a number of extension arms fixed at to said fork conveyor to extend substantially at right angles therewith. These extension arms of both of the fork conveyors are associated with each other in such a manner that each of the extension arms of one of the fork conveyors is arranged at the same level as the associated extension arm of the other of the fork conveyors and that the extension arms on the inner side of each fork conveyor are opposed to each other and move downwardly at the same speed. A board to be dried is supplied to the uppermost horizontal extension arms at the inner sides of the fork conveyors and is carried downwardly by the extension arms during which the board is dried by heated air circulated through space between the fork conveyors in the lengthwise direction of the boards.

4 Claims, 3 Drawing Figures

BOARD DRYING APPARATUS

BACKGROUND OF THE INVENTION

The present invention relates to a board drying apparatus for drying boards which still contain a large amount of water such as, for example, veneer, calcium silicate board, pulp cement board, plaster board and fiber board.

A conventional board drying apparatus includes a wicket type drying machine having a fork conveyor. In this fork conveyor, a plurality of endless chain conveyors each having a number of extension arms like a comb are arranged side by side in the horizontal direction. A feed conveyor for a board to be dried and a discharge conveyor for the dried board are arranged horizontally at opposite ends of the fork conveyor in such a manner that ends of the feed conveyor and discharge conveyor partially extend into spaces between the endless chain conveyors forming the fork conveyor. A relatively large board to be dried and carried by the feed conveyor is fed in the horizontal direction to one end of the fork conveyor, from where the board enters into a space between the adjacent extension arms and then gradually is erected as the extension arms rise from the horizontal to the vertical by the rotation of the endless chain conveyors. Thus, the board to be dried is vertically held by the adjoining extension arms and carried along a horizontal path of the endless chain conveyors during which drying treatment is carried out. The dried board is discharged onto the discharge conveyor from the other end of the fork conveyor while the board turns from the vertical to a horizontal posture.

However, in the conventional wicket type drying machine, ends of the feed conveyor and discharge conveyor partially enter into spaces between the endless chain conveyors which are arranged side by side and have many extension arms to form the fork conveyor. Accordingly, when boards of small size are to be treated by the convetional wicket type drying machine, there is a possibility that such small boards fall down through the space between the adjacent extension arms, whereby delivery of the boards onto and out of the fork conveyor is troublesome.

Also, in the conventional wicket type drying machine, small boards having small widths will often fall down in the transverse direction of the fork conveyor when the boards are erected from the horizontal posture at the feeding end of the conveyor, especially when the boards have an irregular shape at the front end thereof. This will prevent continuous transfer of the boards to be treated.

Further, according to the ordinary transfer mode in conventional wicket type board drying machines of this type, boards to be dried are fed first horizontally, then erected vertically halfway at the transfer path and moved, and thereafter again returned to the horizontal posture. Consequently, when a board is erected vertically during transfer, the moisture contained therein moves downward due to gravity, thus causing a remarkable bias in moisture distribution in the vertical direction, which leads to an imbalance of moisture content in a finished state and an arcuate deformation due to the difference in shrinkage at front, rear, right and left portions of the board. Thus, the product quality is badly deteriorated.

Accordingly, an object of the present invention is to eliminate these drawbacks of the conventional board drying apparatus.

Another object of the present invention is to provide a board drying apparatus which causes no difficulty in the delivery of the boards from a feed conveyor and to a discharge conveyor.

A further object of the present invention is to provide a board drying apparatus which can smoothly transfer not only a large sized board but also a small sized board for drying treatment, even though the board has an irregular shape at the front end thereof.

Still another object of the present invention is to provide a board drying apparatus which can homogeneously dry the board without an imbalance of moisture content.

SUMMARY OF THE INVENTION

According to the present invention, there is provided a board drying apparatus which comprises a closed housing, a pair of fork conveyors provided in the housing and disposed vertically with spacing therebetween, each fork conveyor having a number of extension arms fixed at ends thereof to the fork conveyor substantially at right angles therewith in such a manner that each of the extension arms of one of the fork conveyors has an associated extension arm at the same level on the other of the fork conveyors and that the extension arms on the inner side of each fork conveyor are opposed to each other and move downwardly at the same speed, means for feeding boards to be dried to the uppermost horizontally positioned extension arms at the inner sides of the fork conveyors, means for discharging the dried boards from the lowermost position of the fork conveyors, heating means for generating heated air in the housing, and blowers for circulating the heated air through space between the fork conveyors in the lengthwise direction of the boards.

Preferably, the board feeding means comprises a feed conveyor provided above and between the pair of fork conveyors. The feed conveyor has a pair of swingable arms which can open at the lower part thereof like a gate, whereby a board on the feed conveyor is placed horizontally on the uppermost horizontal extension arms of the form conveyors.

Other objects and features of the present invention will become apparent from the following detailed explanation of a preferred embodiment of the present invention, when taken in conjunction with the accompanying drawings, in which:

DETAILED DESCRIPTION OF PREFERRED EMBODIMENT OF THE INVENTION

Figure 1:
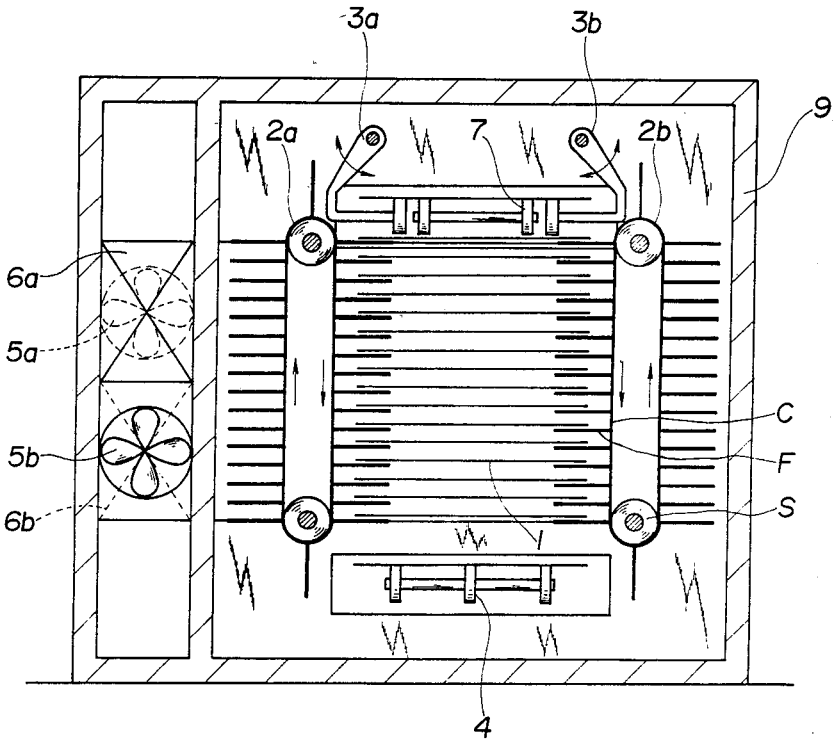
FIG. 1 is a front view, partially broken away, of a board drying apparatus according to a preferred embodiment of the present invention.

A board drying apparatus according to a preferred embodiment of the present invention comprises a closed housing 9 in which a pair of fork conveyors 2*a* and 2*b* are disposed vertically with spacing therebetween. Each fork conveyor 2*a* or 2*b* has front and rear endless chains (C) in a double row which are entrained about upper and lower sprockets (S). The endless chains (C) in the row have a number of frame-like extension arms (F) at suitable intervals. Each extension arm (F) is formed by connecting metal rods in a rectangular configuration and fixed at ends thereof to the chains in the row at right angles with the latter. These extension arms (F) of the fork conveyors 2*a*, 2*b* are arranged in such a manner that each of the extension arms of one of the fork conveyors has an associated extension arm at the same level on the other of the fork conveyors and that extension arms on the inner side of each fork conveyor are opposed to each other and move downwardly at the same speed. The length of the extension arms (F) for supporting opposite sides of a board to be dried is set at an appropriate value while taking into account the flexibility and strength of the board. It should be noted here that the distance between the front and rear endless chains in each fork conveyor is greater than the distance between the front endless chains or rear endless chains of the two fork conveyors 2*a* and 2*b*, so that a large rectangular shaped board longer in the front-to-rear direction can be treated for drying.

Provided above and between the fork conveyors 2*a*, 2*b* is a delivery conveyor having a pair of gate-like swingable arms 3*a* and 3*b*. The swingable arms 3*a* and 3*b* are opposed to each other in the form of a gate and, when closed, support the board to be dried horizontally from both sides thereof. When the swingable arms 3*a*, 3*b* are opened, the board is dropped onto the uppermost horizontally positioned extension arms (F) of the fork conveyors 2*a* and 2*b*. Thus, the delivery conveyor is so constructed as to repeat such intermittent opening and closing delivery operations.

In line with the delivery conveyor 3*a*, 3*b* is a feed conveyor 7 which extends from one end portion of the delivery conveyor to the outside of the housing 9. The boards to be dried are fed from the feed conveyor 7 to the delivery conveyor and then to the fork conveyors 2*a*, 2*b* as set forth hereinabove.

Provided below and between the conveyors 2*a* and 2*b* is a discharge conveyor 4 which extends horizontally beyond the housing 9. This discharge conveyor 4 is arranged to receive the dried board from the lowermost pair of extension arms (F) when the latter open downwardly like a gate by rotating about the respective lower sprockets. The dried board thus received by the discharge conveyor 4 is carried outside of the housing 9 by a transport conveyor 8.

The housing 9 also includes fans 5*a*, 5*b* and heaters 6*a*, 6*b* disposed in series at a side portion in the interior thereof. The heaters 6*a* and 6*b* may be in the form of steam-heated Aerofine heaters. As an example of other heating sources, hot gas may be introduced into the housing 9 directly from a boiler.

For supplying and circulating hot air between layers of boards 1 to be dried as the boards continue to move downwardly while being horizontally supported and carried by the fork conveyors 2*a* and 2*b*, the hot air supply region usually is divided into upper and lower or upper, middle and lower sections, and the temperature and humidity of each hot air supply section are made adjustable in accordance with drying conditions. For example, as shown in the drawings, the upper and lower two-stage fans 5*a*, 5*b* and heaters 6*a*, 6*b* or other heating source divide the hot air supply region into upper and lower sections, and in many cases the upper and lower blowing directions are reversed to make the degree of drying uniform.

Further, though not shown, distributors of an appropriate shape are disposed before and behind the fork conveyors 2*a* and 2*b* which serve as the hot air circulating path in the housing 9. Such distributors cooperate with buffer chambers disposed just therebefore so that the distributed hot air portions may act uniformly on the upper, lower, right and left sides of the boards 1.

Figure 2:
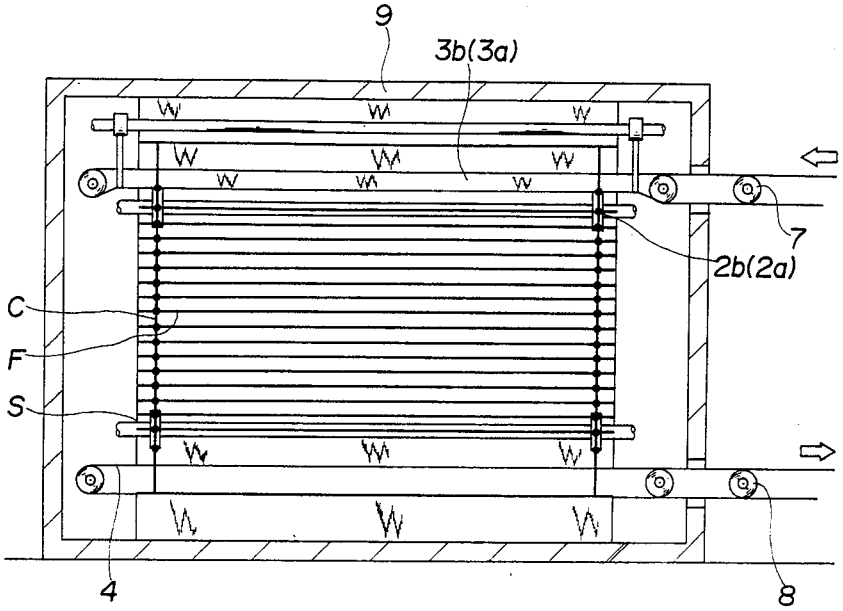
FIG. 2 is a side view of the apparatus shown in FIG. 1.
Figure 3:
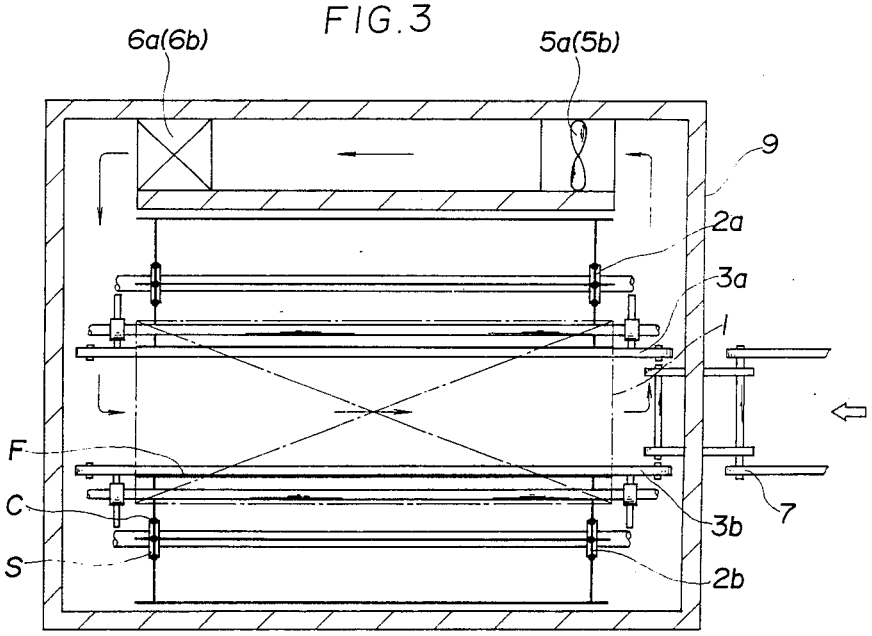
FIG. 3 is a plan view of the apparatus shown in FIG. 1.

Now, referring to the operation of the board drying apparatus of the present invention shown in FIGS. 1 to 3, a board to be dried is first fed onto the delivery conveyor 3 by means of the feed conveyor 7, and the presence of the board is detected by a detector such as a limit switch disposed in a suitable position. A signal from such detector activates an actuator such as an air cylinder for operating the gate-like swingable arms 3*a* and 3*b*, whereby the arms 3*a* and 3*b* are opened and the board is placed horizontally onto the uppermost horizontal pair of extension arms F of the fork conveyors 2. Thus, the boards are successively put on the extension arms F and then carried downwardly. During this downward movement the boards are exposed at both faces thereof to hot air produced and circulated in the horizontal direction by the heaters 6*a*, 6*b* and fans 5*a*, 5*b* and thereby dried rapidly. It should be noted here that since the heaters 6*a*, 6*b* and fans 5*a*, 5*b* are disposed in series at one side portion of the housing 9, the hot air is circulated through the space between the fork conveyors, as shown by arrows in FIG. 3. This means that the hot air flows along the lengthwise direction of the boards 1 to be dried. Such a flow pattern of the hot air minimizes curling or bending of the dried boards compared with a flow pattern of hot air in the sidewise direction of the boards. Especially, when the flow direction of the hot air caused by the upper fan 5*a* and upper heater 6*a* is reversed with that caused by the lower fan 5*b* and lower heater 6*b*, more homogeneous drying can be achieved with less curling or bending of the board. Then, the boards 1 thus dried are discharged successively from the lowermost extension arms F of the fork conveyor onto the just underlying discharge conveyor 4 and carried out of the housing 9 by the transport conveyor 8.

As will be understood from the disclosure of the present invention set forth above, since the board to be dried is carried in the horizontal direction and put on the uppermost extension arms of the fork conveyors in a horizontal posture, the delivery of the board onto the fork conveyors for drying treatment can be carried out very easily without changing the horizontal posture of the board. Likewise, the delivery of the dried board onto the discharge conveyor from the fork conveyors can be carried out very easily, since the discharge conveyor is provided below the fork conveyor for discharging the dried board in the horizontal direction.

Further, since the board to be dried is fed from above the fork conveyors and is received by the uppermost horizontal extension arms of the fork conveyors, there is no difficulty in delivering a small sized board to the fork conveyors, even if the board has an irregular front end.

Furthermore, since the drying treatment is carried out by blowing and circulating hot air against both faces of the board while being horizontally supported and moved downwardly within the housing, the conventional inconveniences such as imbalance of moisture content in a finished state of the board and an arcuate deformation caused by the difference in shrinkage can be eliminated and a homogeneously dried board can be provided.

Furthermore, since the heater and fan are disposed in series at one side portion of the housing, the hot air flows through the space between the fork conveyors in the lengthwise direction of the board. This flow pattern minimizes the curling or bending of the dried board.

Although the present invention has been described with reference to a preferred embodiment thereof, many modifications and alternations can be made within the spirit of the present invention.

What is claimed is:

1. A board drying apparatus comprising:

a substantially closed housing;

a pair of fork conveyors disposed vertically in said housing with spacing therebetween and having inner sides opposed to each other;

each fork conveyor having a plurality of extension arms fixed at ends thereof to said fork conveyor to extend substantially at right angles thereto, in such a manner that each of said extension arms of one of said fork conveyors has an associated extension arm at the same level on the other of said fork conveyors, and that the said extension arms on said inner sides of said fork conveyors are opposed to each other and are moved downwardly at the same speed;

means for feeding boards to be dried to the uppermost horizontally positioned said extension arms at said inner sides of said fork conveyors, said feeding means comprising a delivery conveyor provided above and between said pair of fork conveyors, said delivery conveyor including a pair of swingable arms operable to be opened at lower portions thereof in the manner of a gate;

means for discharging the dried boards from the lowermost position of said fork conveyors;

heating means for producing heated air in said housing;

blower means for circulating the heated air through space between said fork conveyors; and said blower means and said heating means being disposed in series in the horizontal direction at a side portion in the interior of said housing to cause the heated air to flow through said space between said fork conveyors in the lengthwise direction of the boards supported thereby.

2. A board drying apparatus as claimed in claim 1, wherein each of said fork conveyors includes front and rear endless chains arranged in a double row, said endless chains having connected thereto said extension arms in the form of frame-like members spaced at intervals.

3. A board drying apparatus as claimed in claim 1, wherein said discharge means comprises a discharge conveyor belt provided directly below and between said pair of fork conveyors, whereby a dried board dropping downwardly from the lowermost said extension arms is placed on said discharge conveyor belt.

4. A board drying apparatus as claimed in claim 1, wherein said heating means comprises upper and lower heaters, and said blower means comprises upper and lower fans disposed in series with said upper and lower heaters, respectively, said upper and lower fans having reverse blowing directions.

* * * * *